US010926557B2

(12) United States Patent
McLaughlin et al.

(10) Patent No.: US 10,926,557 B2
(45) Date of Patent: Feb. 23, 2021

(54) VACUUM TRANSPORT HAVING JETTING AREA ALLOWING PERIODIC JETTING OF ALL NOZZLES

(71) Applicant: Xerox Corporation, Norwalk, CT (US)

(72) Inventors: Matthew R. McLaughlin, Rochester, NY (US); Frank B. Tamarez Gomez, Webster, NY (US); Rachel L. Tanchak, Rochester, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 18 days.

(21) Appl. No.: 16/352,992

(22) Filed: Mar. 14, 2019

(65) Prior Publication Data

US 2020/0290373 A1 Sep. 17, 2020

(51) Int. Cl.

| | |
|---|---|
| ***B41J 11/00*** | (2006.01) |
| *B41J 2/17* | (2006.01) |
| *B41J 2/165* | (2006.01) |

(52) U.S. Cl.

CPC ..... *B41J 11/0085* (2013.01); *B41J 11/0095* (2013.01); *B41J 2/16585* (2013.01); *B41J 11/007* (2013.01); *B41J 2002/1742* (2013.01)

(58) Field of Classification Search

CPC .... B41J 2/16585; B41J 2/1721; B41J 11/007; B41J 11/0085; B41J 2002/1742; B65H 2406/32231; B65H 5/224

See application file for complete search history.

(56) References Cited

U.S. PATENT DOCUMENTS

| | | | | |
|---|---|---|---|---|
| 5,040,000 | A * | 8/1991 | Yokoi | B41J 2/16547 346/134 |
| 5,617,124 | A | 4/1997 | Taylor et al. | |
| 5,805,182 | A | 9/1998 | Lee | |
| 6,106,090 | A * | 8/2000 | Uchida | B41J 11/007 347/104 |
| 6,213,583 | B1 | 4/2001 | Therien | |
| 6,318,838 | B1 | 11/2001 | Anderson et al. | |
| 6,340,220 | B1 | 1/2002 | Gaylor et al. | |
| 6,523,932 | B2 | 2/2003 | Johnson | |
| 6,616,266 | B2 | 9/2003 | Neal et al. | |
| 6,644,772 | B2 | 11/2003 | Choi | |
| 6,860,583 | B2 | 3/2005 | Cheney et al. | |
| 7,040,734 | B2 * | 5/2006 | Nakashima | B41J 2/16585 347/104 |
| 7,399,048 | B2 * | 7/2008 | Inoue | B41J 29/393 347/16 |
| 8,303,104 | B2 * | 11/2012 | Miyagi | B41J 2/16585 346/139 R |
| 8,382,242 | B2 | 2/2013 | Rosati et al. | |
| 8,702,189 | B2 * | 4/2014 | Watanabe | B41J 2/2114 347/9 |

(Continued)

*Primary Examiner* — John Zimmermann
(74) *Attorney, Agent, or Firm* — Gibb & Riley, LLC

(57) ABSTRACT

Devices include an inkjet printhead having nozzles and a transport item adjacent the nozzles. The transport item includes vacuum openings adapted to maintain print media on the transport item. The transport item moves the print media in a processing direction. The transport item also includes a jetting area lacking the vacuum openings. The jetting area is elongated and is oriented perpendicular to the processing direction. The nozzles are controlled to eject ink to the jetting area when the nozzles are aligned with the jetting area.

18 Claims, 9 Drawing Sheets

(56) References Cited

U.S. PATENT DOCUMENTS

| | | | | |
|---|---|---|---|---|
| 9,004,631 | B1 | 4/2015 | Folkins et al. | |
| 9,579,908 | B2 * | 2/2017 | Akahori | B41J 11/0085 |
| 2002/0018097 | A1 * | 2/2002 | Kitahara | B41J 11/0085<br>347/42 |
| 2004/0100544 | A1 * | 5/2004 | Okamoto | B41J 11/007<br>347/104 |
| 2005/0078145 | A1 * | 4/2005 | Inoue | B41J 2/16585<br>347/31 |
| 2010/0053254 | A1 * | 3/2010 | Ito | B41J 11/007<br>347/19 |

* cited by examiner

VACUUM TRANSPORT HAVING JETTING AREA ALLOWING PERIODIC JETTING OF ALL NOZZLES

BACKGROUND

Field of the Invention

Systems and methods herein generally relate to vacuum transports for inkjet printers and more particularly to printing devices that have a vacuum belt and that periodically perform inkjet jetting.

Description of Related Art

Vacuum belts are often used to transport sheets of material, such as sheets of paper, plastic, transparencies, card stock, etc., within printing devices (such as electrostatic printers, inkjet printers, etc.). Such vacuum belts have perforations (which are any form of holes, openings, etc., through the belt), that are open to a vacuum manifold through which air is drawn. The vacuum manifold draws in air through the perforations, which causes the sheets to remain on the top of the belt, even as the belt moves at relatively high speeds. The belt is generally supported between two or more rollers (one or more of which can be driven) and is commonly used to transport sheets from a storage area (e.g., paper tray) or sheet cutting device (when utilizing webs of material) to a printing engine.

In addition, printers improve performance by preventing nozzles (jets) of inkjet printheads from clogging. When jets in aqueous inkjet printheads are not used for extended periods, the ink dries out in these jets which interferes with future printing operations.

SUMMARY

Various exemplary devices herein include one or more inkjet printheads having nozzles, a transport item adjacent the nozzles, and a cleaning station contacting the transport item. The transport item moves print media in a processing direction. The transport item includes vacuum openings, adapted to maintain the print media on the transport item, and a plurality of jetting areas lacking any vacuum openings. Further, a controller can be electrically connected to the inkjet printhead and the transport item.

In one example, the transport item can be a belt having a seam oriented perpendicular to the processing direction, and a jetting area is located at the seam. Also, an optical sensor can be included that is adapted to detect positions of sheets of the print media relative to the jetting area, to evaluate whether the seam is covered by print media.

The jetting area is elongated and is oriented perpendicular to the processing direction. Nozzles that have gone unused for more than a non-use time limit are controlled to eject ink to the jetting area at a point when the nozzles are aligned with the jetting area. For example, the controller can be adapted to control the nozzles to eject ink only from nozzles that have not ejected ink for more than a time limit. This time limit can be different for different color inks. Similarly, the sheets can be controlled by the controller to not be positioned over the seam or the printhead can be controlled by the controller to avoid ejecting the jetted ink on the sheets that cover the seam, when that situation occurs. The cleaning station is adapted to remove the jetted ink from the jetting area.

Also, inter-document zones are locations on the transport item between the sheets of print media. In different embodiments, the jetting area is located within one or more of the inter-document zones. Further, the size of the jetting areas can be large enough to allow multiple nozzles to simultaneously eject ink to the jetting areas.

Various methods herein move, as controlled by the controller, the transport item in the process direction to transport the print media (in the process direction) past the nozzles of the inkjet printhead. Additionally, these methods control the nozzles to eject ink on the jetting area when the nozzles are aligned with the jetting area (potentially only from nozzles that have not ejected ink for more than the non-use time limit). The process of controlling the nozzles to eject ink includes steps of detecting positions of the sheets of print media relative to the jetting area, using an optical sensor, to avoid ejecting ink on the sheets that cover the jetting area, and using another optical sensor to identify specific nozzles that are clogged and need jetting. The process of controlling the nozzles to eject jetted ink can be performed by simultaneously ejecting jetted ink to the jetting areas from multiple nozzles.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

Figure 1:
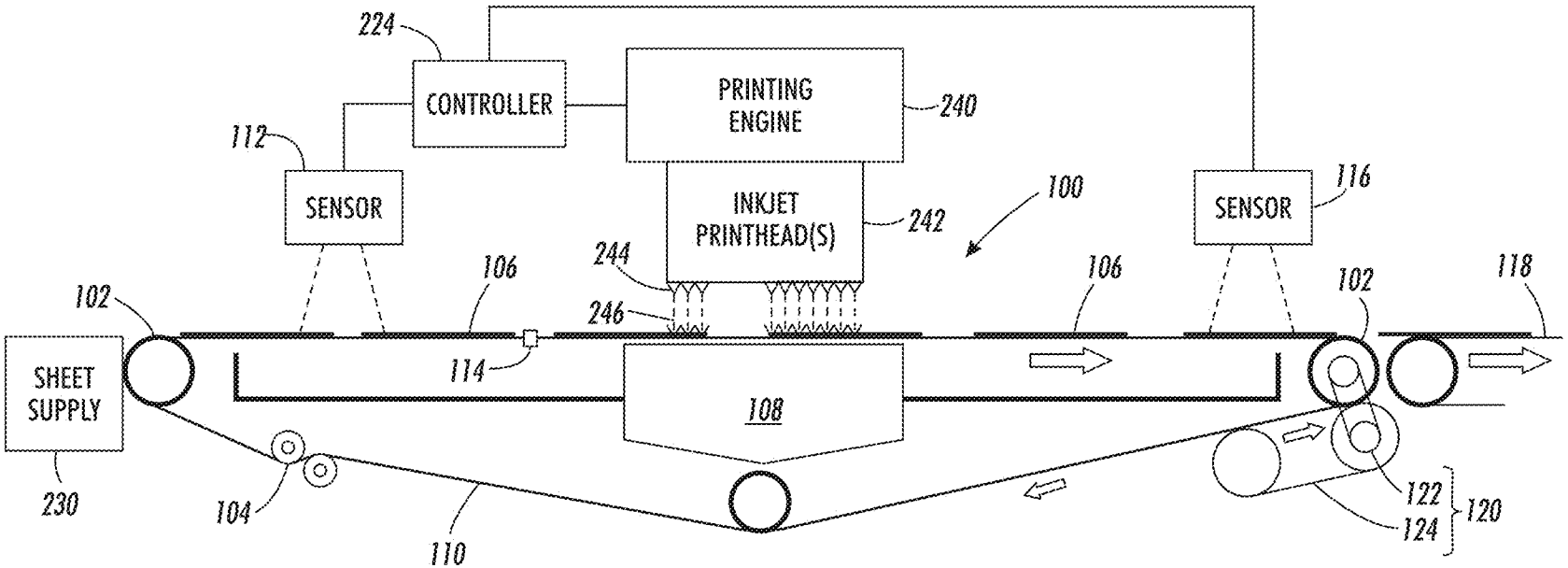
FIG. 1 is a side-view schematic diagrams illustrating a media path herein.

As mentioned above, when jets in aqueous inkjet printheads are not used for extended periods, the ink dries out and clogs these jets, which interferes with future printing operations. This problem is exacerbated when printing on narrow width paper because this can cause the jets at the edges of the printhead to not be used for extended periods. When a later print job is then run on wider paper, the jets that have not been used recently may be difficult to recover. For very stubborn jets, the printhead can be removed from the printer and recirculated on a special fixture for many hours, leaving the printer not functional for that time.

Sometimes jets that are located over paper, but not being used for the current image are "exercised" by being fired in a random background pattern on each page, and this procedure is sometimes called "sneezing." Such processing involves randomly jetting in very low coverage so that the ink jetted on to the print media is not visible to the naked eye, and over many sheets. This keeps the ink in each jet active but does not help jets outside of the loaded paper size. Disadvantageously, this approach can result in unwanted images on the output that are sometimes accommodated by being treated as a "chip out" where the sneezed images are physically cut out of a web of print media. Further, jetting on narrow sheets risks spraying ink directly on the belt and contaminating the system.

Also, jetting of the maximum print zone using sacrificial sheets can be accomplished, for example, by periodically feeding an elongated sacrificial sheet (e.g., legal size paper) with the longest dimension oriented perpendicular to the processing direction (in the cross-processing orientation) to allow all nozzles in the maximum print zone to be jetted onto the cross-processing oriented sacrificial legal size sheet. However, if one does not regularly print on elongated sheets, this could require users to unnecessarily devote a paper tray in the feeder solely to longer sheets, which may be inconvenient or uneconomical, especially if the user never prints on that size sheet.

In view of this, the devices and methods herein provide maintenance jetting of unused jets in cut-sheet applications to one or more jetting areas that are belt regions that are without vacuum holes, as well as a cleaning belt system to remove the maintenance ink from the jetting areas, post jetting. The systems herein control the jetting area to ensure that ink is jetted onto the seam area and not into the belt holes or media (and this accounts for belt position errors, print head process direction errors, belt speed errors, image output product shifts, sheet registration variations, etc.).

The cleaning station is provided to effectively remove ink from the seam area. Immediately cleaning the seam area of jetted ink avoids redepositing ink on the belt. To assist in cleaning, the belt surface may be treated with a coating to minimize ink adhesion of the jetting ink to the belt.

Further, the devices herein minimize belt motion and vibration, to avoid impacting image quality. This is achieved by keeping the cleaning belt in constant contact with the marker belt to avoid belt motion and the associated possible image disturbance that could occur with an intermittent engagement. To further prevent belt motion/vibration the cleaning system is provided with a fixed and reasonable inertia, through the selection of an appropriate motor and drive pulleys. In one example, the cleaning belt can be coupled to the marker transport drive. In other examples, the cleaning belt can use its own drive motor, which allows the cleaning belt to run at a slightly higher velocity to aid in ink removal.

The seam and jetting area can be located via optical sensor and/or strategically located feature. The jetting area can be a light or white color to allow the optical scan bar to do periodic runtime monitoring of the cleanliness of the jetting area (which may indicate that the cleaning belt needs replacement, etc.). Further, such optical sensors allow the systems and methods herein to determine the seam position relative to media sheet positions to ascertain when the seam resides in an inter-document zone. In some implementations, if the seam is covered for extended time the system and methods herein can insert a skipped (sacrificial) page to allow the maintenance jetting to occur on the skipped page.

Therefore, the systems and methods herein maintain full width jet health during production with no productivity loss for narrow cut sheet architectures. Further, such systems/methods keep the full width of nozzles healthy without frequent sacrificial maintenance sheets, produce cost savings by reducing jetting cycles, prevent dried jets when switching from narrow to wide media, and improve jet health for applications with low image content.

Therefore, devices herein can be, for example, a printing apparatus shown in FIG. 1 (and FIG. 8, discussed in detail below) that can include, among other components a media supply 230 storing print media, a media path 100 having a transport item 110 that includes perforations between the belt edges, and a vacuum manifold 108 positioned adjacent (below) the transport item 110 in a location to draw air through the perforations.

The generic media supply 230 shown in the accompanying drawings can include various elements such as a paper tray, feeder belts, alignment guides, etc., and such devices can store cut sheets, and transport the cut sheets of print media to the transport item 110.

As shown in FIG. 1, the transport item 110 is supported between rollers 102, at least one of which is driven, and the belt 110 is kept under proper tension using tensioning rollers 104. The transport item 110 is generally a long, flat material (potentially made of many layers of different materials) the ends of which are joined at a seam 114. Therefore, the seam 114 creates a continuous loop of material that is supported and rotated by the rollers 102.

Also, a print engine 240, having inkjet printheads 242 with nozzles 244 that eject liquid ink 246, is positioned adjacent the transport item 110 in a location to receive sheets from the transport item 110. A processor 224 is electrically connected to the print engine 240, drive rollers 102, sensors, etc. After the print engine 240 prints on sheets of media 106, the sheets of media 106 are transferred to another belt 118 for additional processing or output.

Further, a first sensor 112 is positioned adjacent the transport item 110 on one side of the print engine 240 to detect gaps between the sheets of media 106 before the sheets of print media 106 pass by the printheads 242. A second sensor 116 is included on the other side of the print engine 240 to evaluate the quality of the printing after the sheets of print media 106 pass by the printheads 242 and or the cleanliness of the transport item 110.

The side of the transport item 110 where the vacuum manifold 108 is located is arbitrarily referred to herein as the "bottom" of the transport item 110, or the area "below" the transport item 110. Conversely, the side of the transport item 110 adjacent where the printhead 242 is located is arbitrarily referred to herein as the "top" of the transport item 110, or the area "above" the transport item 110. However, despite these arbitrary designations, the device itself can have any orientation that is useful for its intended purpose.

Once the printed sheets of media 106 are transferred off the top of the transport item 110, the top of the vacuum belt passes by a cleaning station 120. As shown in FIG. 1, the cleaning station 120 includes a cleaning member 124 (such as a belt, rotating brush, etc.) that can be stationary or can be moved or rotated using a driven unit 122 (such as a belt or motor driven roller, etc.). The components of the cleaning station 120 are balanced to prevent generating vibrations and the cleaning station 120 is kept in constant contact with the transport item 110 to avoid affecting belt motion. This prevents the transfer of vibrations and/or movement to the transport item 110 to eliminate image disturbances that could occur if the transport item 110 were vibrated or moved in an unexpected way.

Further, the cleaning member 124 can be rotated or moved in an opposite direction to the movement of the transport item 110 to promote cleaning of the transport item 110. The location of the cleaning station 120 relative to the transport item 110 is a location where the sheets of media 106 are not transported, allowing the cleaning member 124 to continuously contact the top of the transport item 110 after discharging the sheets of media 106 and while returning to the printheads 242. The cleaning member 124 can rub against the top of the transport item 110 (if moved by driven unit 122) to remove any ink 246 that has been ejected on the top of the transport item 110 by the printheads 242.

Figure 2:
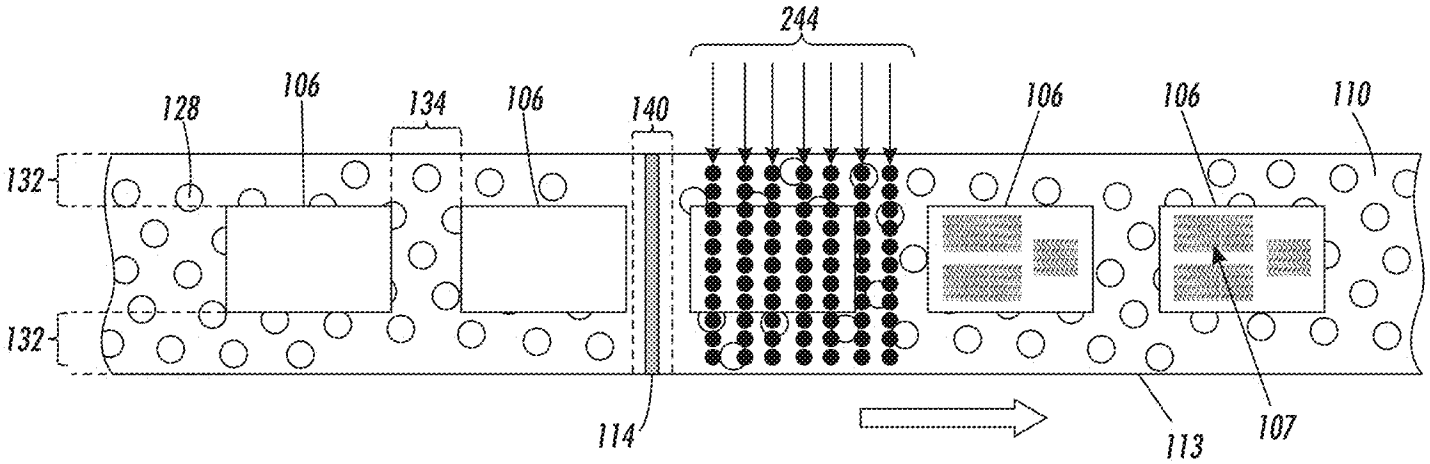
FIGS. 2-7 are top-view schematic diagrams illustrating a vacuum belt herein.

While FIG. 1 shows a side view of the media path 100, FIG. 2 is a schematic diagram illustrating a top view (plan view) of the transport item 110 that is rotated 90° relative to FIG. 1. As can be seen in FIG. 2, the transport item 110 includes vacuum openings/perforations 128 and FIG. 2 shows the locations of the nozzles 244 (without illustrating the printheads 242, etc., to allow the transport item 110 to be more easily seen). The vacuum openings 128 are adapted to maintain the print media 106 on the transport item 110. As further shown in FIG. 2, the transport item 110 moves print media 106 in a processing direction (shown by block arrow) past the nozzles 244 to print markings 107 on the print media 106.

FIG. 2 also illustrates that the sheets of media 106 can be narrower than the transport item 110 which leaves uncovered lateral spaces 132 between the edges of the media 106 and the belt edges 113 (in the cross-process direction that is perpendicular to the process direction). Similarly, the sheets of media 106 can be arranged on the transport item 110 to leave a space or gap between the sheets of media 106 (inter-document zone (IDZ) or inter-document gap 134), the locations of which can be detected by the first sensor 112.

Thus, in one example, lateral openings 128 and lateral nozzles 244 are in the lateral spaces 132 and are positioned in a cross-process direction from the edges of the sheets, such that the lateral openings 128 and lateral nozzles 244 are between the belt edges and the parallel edges of the sheet of print media 106. These lateral nozzles 244 eject ink 246 less frequently than the nozzles 244 positioned over the sheets of media 106 and therefore have a higher need to undergo periodic maintenance ink ejections in jetting processes.

FIG. 2 also illustrates a jetting area 140 that includes the seam 114 and areas of the transport item 110 located on both sides of the seam 114. All jetting areas herein lack any vacuum openings 128. As can be seen in FIG. 2, the seam 114 and jetting area 140 are oriented perpendicular to the processing direction. The cleaning station 120 is adapted to remove the jetted ink 246 from the jetting area 140. The jetting area 140 optionally has a coating, such as PTFE (Polytetrafluoroethylene), etc., to minimize ink adhesion and allow easier cleaning.

The first optical sensor 112 is adapted to detect positions of sheets of the print media 106 relative to the jetting area 140 to determine whether any of the sheets of print media 106 cover the jetting area 140. Additionally, the jetting area 140 are devoid of, and do not include, any vacuum openings 128 in order to avoid ejecting any ink 246 into the vacuum manifold 108, which could clog or damage the vacuum manifold 108 and associated ducting and vacuum fan(s).

Because the jetting area 140 is to be cleaned, the systems and methods herein employ many processes to reduce the amount of ink 246 that is jetted. Minimizing the volume of ink 246 jetted to the jetting area 140 makes cleaning easier and reduces the chances of unintended contamination of other sheet transportation elements.

For example, while all nozzles 224 could be periodically simultaneously jetted, in order to minimize the volume of ink 246 jetted, just the nozzles 244 that have gone unused for more than a non-use (idle) time limit are controlled to eject ink 246 to the jetting area 140 (at a point when the nozzles 244 are aligned with the jetting area 140). The idle time limit can be different for different color inks to again help minimize the volume of ink 246 jetted. Also, to avoid image defects, the printhead 242 can be controlled by the controller 224 to avoid ejecting the ink 246 when any of the sheets of print media 106 cover the jetting area 140, and the sheets of print media 106 can be controlled by the controller 224 to not be positioned over the seam 140.

Figure 3:
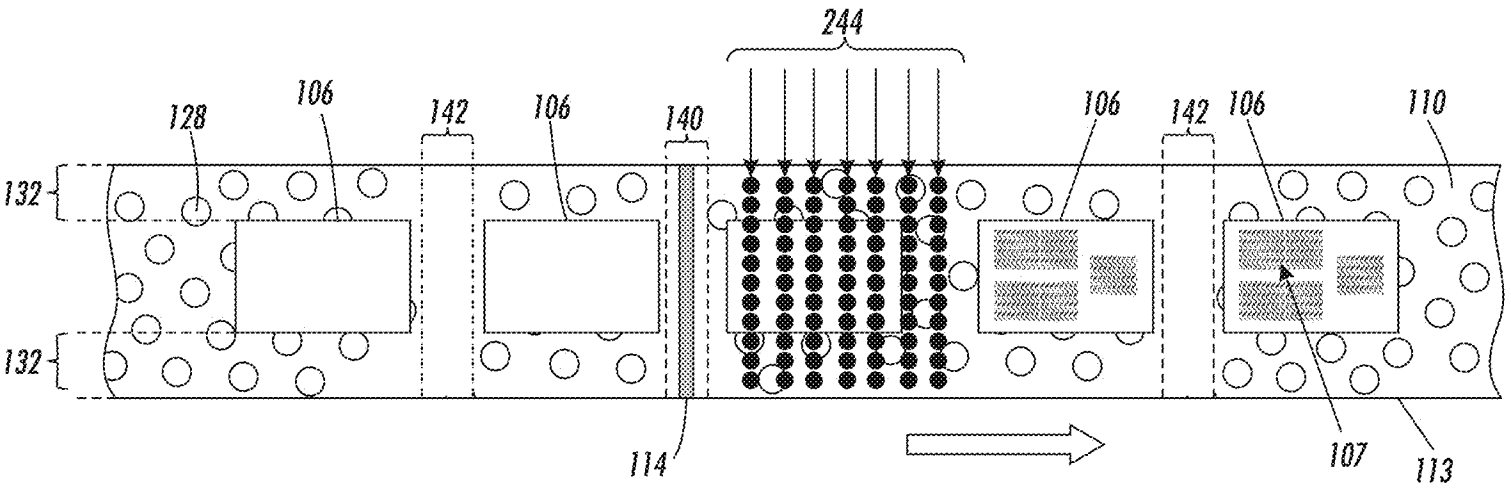

In a different embodiment, as shown in FIG. 3, one or more additional IDZ jetting areas 142 can be located within one or more of the inter-document zones 134. The IDZ jetting areas 142 can be included in addition to, or in place of the jetting area 140 that contains the seam 114. Generally, each belt includes a single seam; however, if multiple seams are included, each could be included in a jetting area 140. Therefore, the jetting areas 140, 142, separate the vacuum openings 128 into distinct groups, adjacent ones of which are separated from one another by the jetting areas 140, 142. Further, the devices and methods herein can apportion jetting ink among the different jetting areas 140, 142 to balance the amount of ink jetted to each different jetting area 140, 142. Also, ink ejections to jetted areas 140, 142 that are not experiencing the same level of cleaning (as determined by the sensor(s)) can be reduced relative to other jetted areas 140, 142 to balance the amount of accumulated uncleanable jetted ink between all jetted areas 140, 142.

Figure 4:
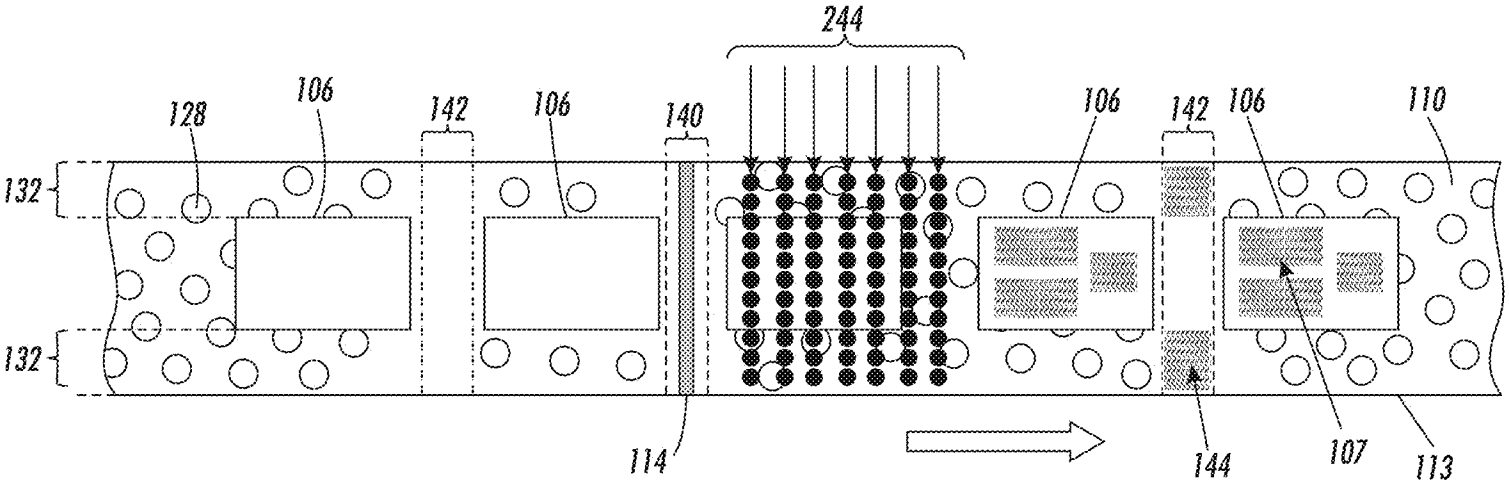
Figure 5:
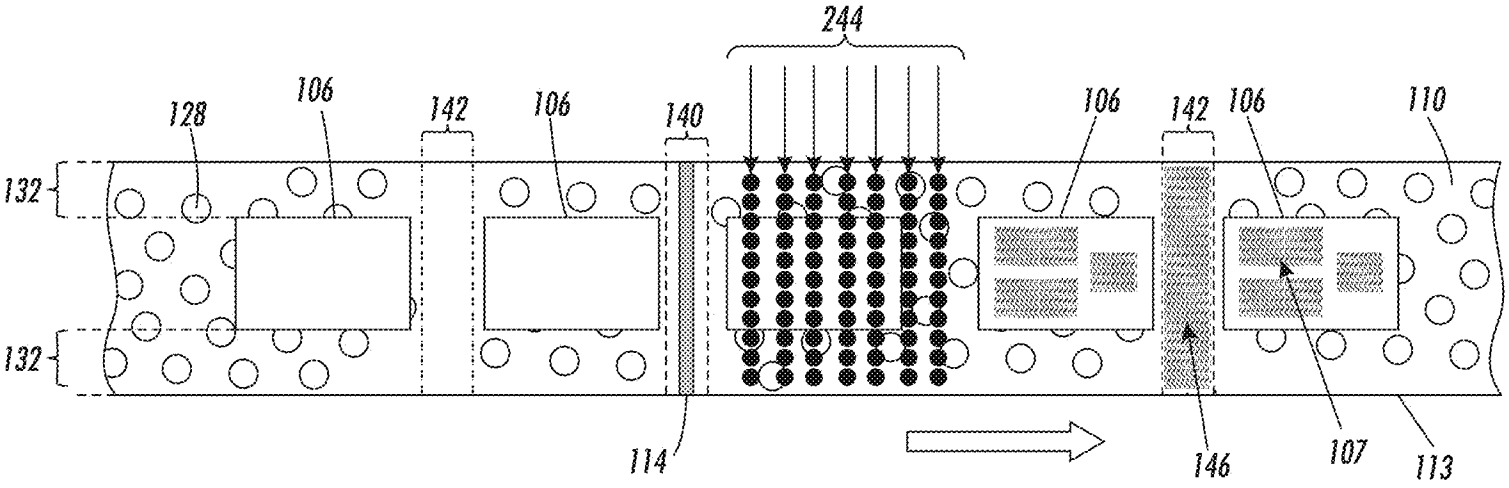

FIG. 4 illustrates that, in some embodiments, jetting can be performed in the jetting areas 140, 142 only in the lateral spaces 132 to leave a pattern of jetting ink 144 (that will be removed by the cleaning station 120), which again minimizes the volume of ink 246 jetted. Alternatively, as shown in FIG. 5, jetting can be performed in the jetting areas 140, 142 using all the nozzles to leave a different pattern of jetting ink 146 (that will also be removed by the cleaning station 120).

Figure 6:
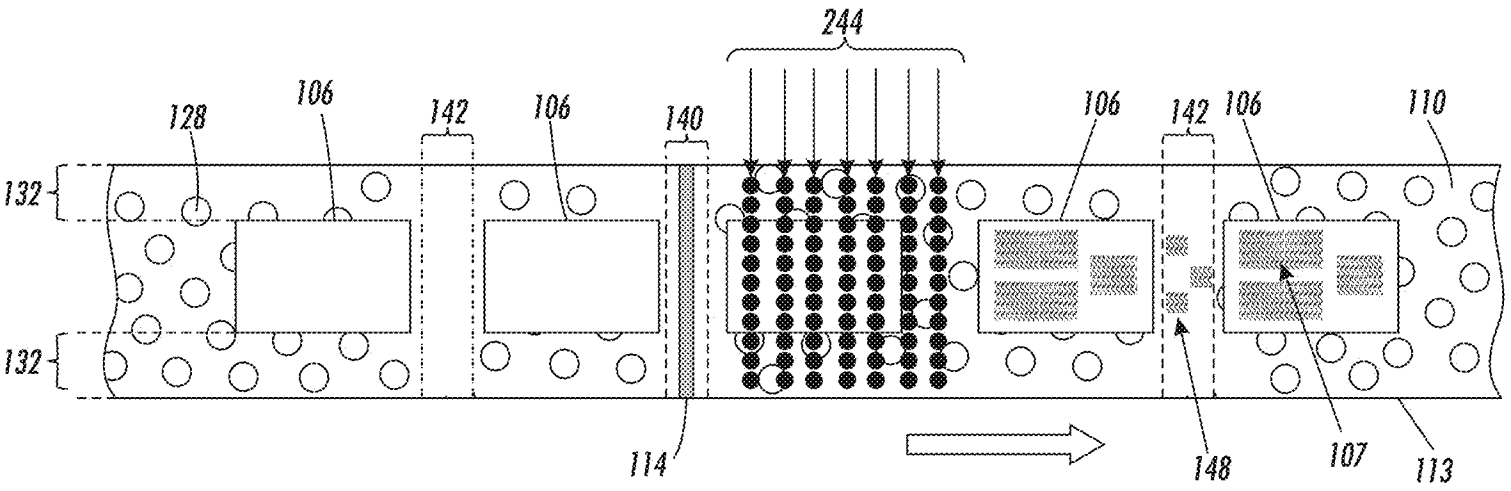

As noted above, the second sensor 116 can detect the quality of the printed markings 107 on the sheets of media 106. This allows the processor 224 to identify nozzles 244 that may be clogged or partially clogged, as well as helps identify and keep track of which nozzles 244 have recently ejected ink (e.g., within the time limit). As additional efforts to minimize the volume of ink 246 jetted, the processor 224 can control the nozzles 244 to only perform jetting on nozzles 244 that are clogged, which produces yet a different pattern of jetting ink 148, as shown in FIG. 6.

Figure 7:
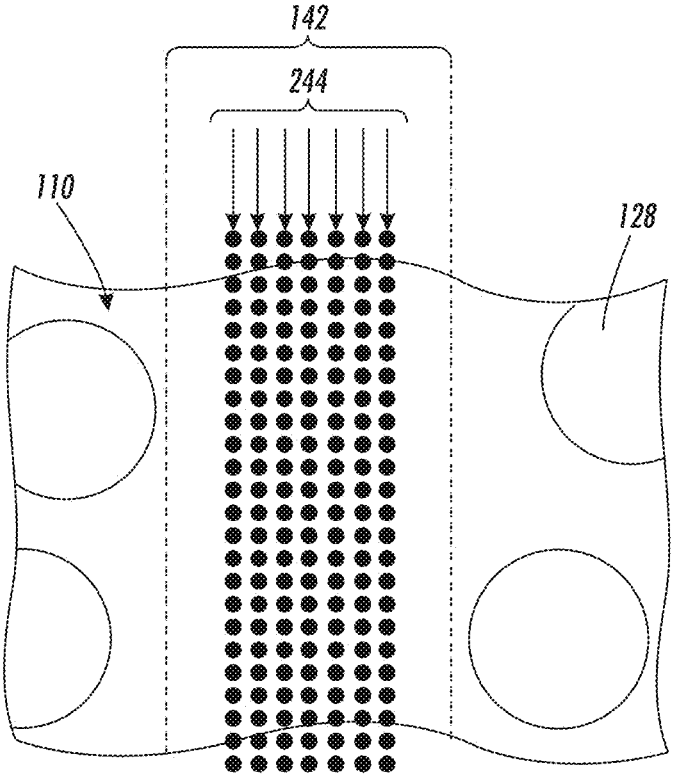

Further, as shown in FIG. 7 the size of the jetting areas 140, 142 can be large enough to allow multiple nozzles 244 to simultaneously eject the ink 246 to the jetting areas 140, 142.

Figure 8:
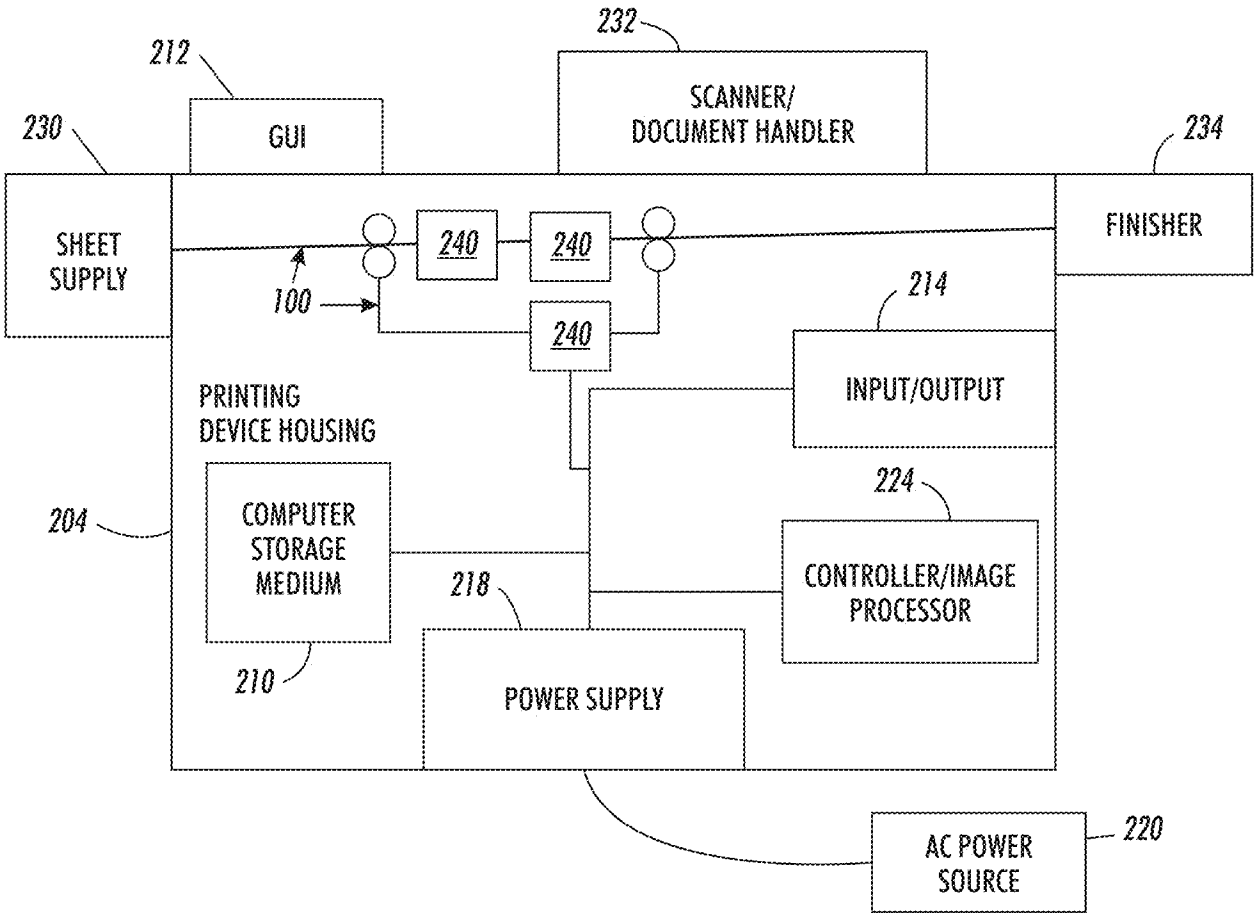
FIG. 8 is a schematic diagram illustrating printing devices herein.

FIG. 8 illustrates many components of printer structures 204 herein that can comprise, for example, a printer, copier, multi-function machine, multi-function device (MFD), etc. The printing device 204 includes a controller/tangible processor 224 and a communications port (input/output) 214 operatively connected to the tangible processor 224 and to a computerized network external to the printing device 204. Also, the printing device 204 can include at least one accessory functional component, such as a graphical user interface (GUI) assembly 212. The user may receive messages, instructions, and menu options from, and enter instructions through, the graphical user interface or control panel 212.

The input/output device 214 is used for communications to and from the printing device 204 and comprises a wired device or wireless device (of any form, whether currently known or developed in the future). The tangible processor 224 controls the various actions of the printing device 204. A non-transitory, tangible, computer storage medium device 210 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 8, a body housing has one or more functional components that operate on power supplied from an alternating current (AC) source 220 by the power supply 218. The power supply 218 can comprise a common power conversion unit, power storage element (e.g., a battery, etc.), etc.

The printing device 204 includes at least one marking device (printing engine(s)) 240 that use marking material, and are operatively connected to a specialized image processor 224 (that is different from a general purpose computer because it is specialized for processing image data), a media path 100 positioned to supply continuous media or sheets of media from a sheet supply 230 to the marking device(s) 240, etc. After receiving various markings from the printing engine(s) 240, the sheets of media can optionally pass to a finisher 234 which can fold, staple, sort, etc., the various printed sheets. Also, the printing device 204 can include at least one accessory functional component (such as a scanner/document handler 232 (automatic document feeder (ADF)), etc.) that also operate on the power supplied from the external power source 220 (through the power supply 218).

The one or more printing engines 240 are intended to illustrate any marking device that applies marking material (toner, inks, plastics, organic material, etc.) to continuous media, sheets of media, fixed platforms, etc., in two- or three-dimensional printing processes, whether currently known or developed in the future.

Figure 9:
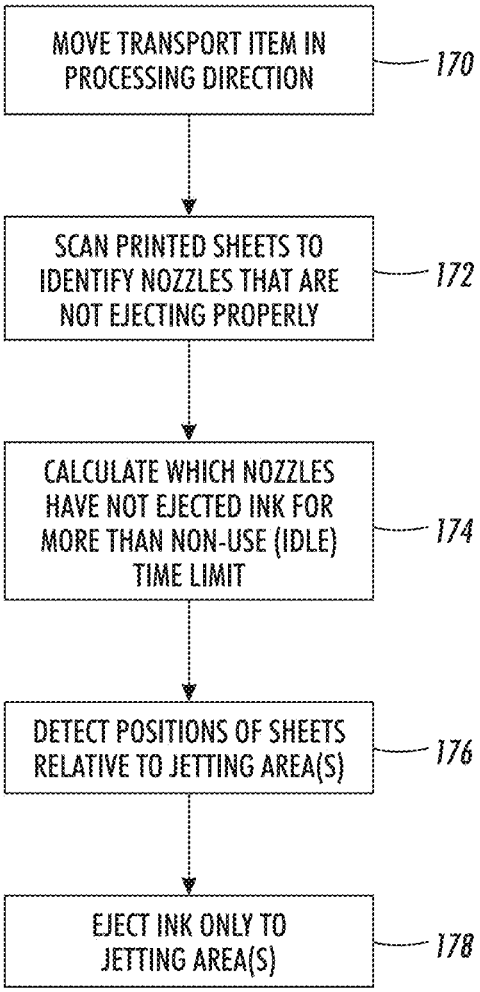
FIG. 9 is a flowchart illustrating methods herein.

FIG. 9 is a flowchart showing that methods herein move, in item 170 as controlled by the controller, the transport item in the process direction to transport the print media (in the process direction) past the nozzles of the inkjet printhead. In item 172, such methods can scan the printed sheets of media to identify nozzles that are not ejecting properly. Also, in item 174, the processor can calculate which nozzles have not ejected ink for more than the non-use (idle) time limit. In item 176, these methods detect the positions of the sheets of print media relative to the jetting area(s), using the optical sensor, so as to avoid ejecting jetted ink on to any sheets that cover the jetting area(s).

Additionally, in item 178, so long as item 176 does not detect sheets in the jetting area to be utilized for maintenance jetting, these methods control the nozzles to eject ink only to the one or more jetting areas when the nozzles are aligned with the jetting area(s). In item 176, all the nozzles from all printheads can eject ink into the jetting area, only nozzles that are not ejecting ink properly can eject ink into the jetting area, or only from nozzles that have not ejected ink for more than the non-use time limit can eject ink into the jetting area. The process of controlling the nozzles to eject jetted ink in item 178 can be performed by simultaneously ejecting jetted ink to the jetting areas from multiple nozzles.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A device comprising:

an inkjet printhead having nozzles; and a transport item adjacent the nozzles, wherein the transport item comprises:

vacuum openings adapted to maintain print media on the transport item, wherein the transport item moves the print media in a processing direction; and a jetting area lacking the vacuum openings, wherein the jetting area is a top of the transport item and is oriented perpendicular to the processing direction, and wherein the nozzles are controlled to eject ink to the jetting area of the top of the transport item when the nozzles are aligned with the jetting area, and wherein the transport item comprises a belt having a single seam where the two ends of the belt are joined to create a continuous loop of belt material, and wherein the seam is oriented perpendicular to the processing direction, and wherein the jetting area is located at the seam.

2. The device according to claim 1, further comprising an optical sensor adapted to detect positions of sheets of the print media relative to the jetting area, wherein the inkjet printhead is controlled to avoid ejecting the ink on the sheets that cover the seam.

3. The device according to claim 1, wherein the transport item comprises inter-document zones between where sheets of the print media are located on the transport item, and wherein the jetting area is located within at least one of the inter-document zones.

4. The device according to claim 1, wherein a size of the jetting area allows multiple ones of the nozzles to simultaneously eject the ink to the jetting area.

5. The device according to claim 1, further comprising a controller electrically connected to the inkjet printhead and the transport item, wherein the controller is adapted to control the nozzles to eject the ink to the jetting area only from nozzles that have not ejected the ink for more than a time limit.

6. The device according to claim 5, wherein the time limit is different for different color inks.

7. A device comprising:

an inkjet printhead having nozzles;

a transport item adjacent the nozzles; and a cleaning station contacting the transport item, wherein the transport item comprises:

vacuum openings adapted to maintain print media on the transport item, wherein the transport item moves the print media in a processing direction; and a jetting area lacking the vacuum openings, wherein the jetting area is a top of the transport item and is oriented perpendicular to the processing direction, wherein unused ones of the nozzles are controlled to eject ink to the jetting area of the top of the transport item when the nozzles are aligned with the jetting area, and wherein the cleaning station is adapted to remove the ink from the jetting area, and wherein the transport item comprises a belt having a single seam where the two ends of the belt are joined to create a continuous loop of belt material, and wherein the seam is oriented perpendicular to the processing direction, and wherein the jetting area is located at the seam.

8. The device according to claim 7, further comprising an optical sensor adapted to detect positions of sheets of the print media relative to the jetting area, wherein the inkjet printhead is controlled to avoid ejecting the ink on the sheets that cover the seam.

9. The device according to claim 7, wherein the transport item comprises inter-document zones between where sheets of the print media are located on the transport item, and wherein the jetting area is located within at least one of the inter-document zones.

10. The device according to claim 7, wherein a size of the jetting area allows multiple ones of the nozzles to simultaneously eject the ink to the jetting area.

11. The device according to claim 7, further comprising a controller electrically connected to the inkjet printhead and the transport item, wherein the controller is adapted to control the nozzles to eject the ink to the jetting area only from nozzles that have not ejected the ink for more than a time limit.

12. The device according to claim 11, wherein the time limit is different for different color inks.

13. A method comprising:

moving, as controlled by a controller, a transport item in a process direction to transport print media in the process direction past an inkjet printhead, wherein the inkjet printhead has nozzles, wherein the transport item comprises: vacuum openings adapted to maintain print media on the transport item; and a jetting area lacking the vacuum openings, and wherein the jetting area is a top of the transport item and is oriented perpendicular to the processing direction, and wherein the transport item comprises a belt having a single seam where the two ends of the belt are joined to create a continuous loop of belt material, and wherein the seam is oriented perpendicular to the processing direction, and wherein the jetting area is located at the seam; and controlling, by the controller, the nozzles to eject ink to the jetting area of the top of the transport item when the nozzles are aligned with the jetting area.

14. The method according to claim 13, wherein the controlling the nozzles to eject the ink comprises:

detecting printing on sheets of the print media;

identify nozzles that are not ejecting properly; and ejecting the ink from the nozzles that are not ejecting properly on the jetting area.

15. The method according to claim 14, wherein the controlling the nozzles to eject the ink comprises:

detecting positions of sheets of the print media relative to the jetting area using an optical sensor; and avoiding ejecting the ink on the sheets that cover the jetting area.

16. The method according to claim 13, wherein the transport item comprises inter-document zones between where sheets of the print media are located on the transport item, and wherein the jetting area is located within at least one of the inter-document zones.

17. The method according to claim 13, wherein the controlling the nozzles to eject the ink comprises simultaneously ejecting the ink to the jetting area from multiple ones of the nozzles.

18. The method according to claim 13, wherein the controlling the nozzles comprises controlling the nozzles to eject the ink to the jetting area only from nozzles that have not ejected the ink for more than a time limit.

* * * * *